US008656595B2

(12) United States Patent
Wong

(10) Patent No.: US 8,656,595 B2
(45) Date of Patent: Feb. 25, 2014

(54) CIGAR CUTTER

(75) Inventor: Ming Wai Wong, Xiamen (CN)

(73) Assignee: ST Dupont, Paris (FR)

( * ) Notice: Subject to any disclaimer, the term of this patent is extended or adjusted under 35 U.S.C. 154(b) by 976 days.

(21) Appl. No.: 12/582,389

(22) Filed: Oct. 20, 2009

(65) Prior Publication Data

US 2010/0146792 A1 Jun. 17, 2010

(30) Foreign Application Priority Data

Oct. 21, 2008 (FR) ..... 08 57139

(51) Int. Cl.
*A24C 1/24* (2006.01)

(52) U.S. Cl.
USPC ..... 30/109; 30/113; 30/278

(58) Field of Classification Search
USPC ..... 30/113, 279.2, 278, 109, 110; 131/253, 131/233
See application file for complete search history.

(56) References Cited

U.S. PATENT DOCUMENTS

| | | | | |
|---|---|---|---|---|
| 1,066,365 | A * | 7/1913 | Battin | 30/113 |
| 1,086,463 | A * | 2/1914 | Robbins | 30/113 |
| 1,119,220 | A * | 12/1914 | Bates | 30/113 |
| 1,166,881 | A * | 1/1916 | Anderson | 30/113 |
| 5,791,051 | A | 8/1998 | Schmidt | |
| 5,893,212 | A * | 4/1999 | Meister | 30/113 |
| 5,937,523 | A | 8/1999 | Van Keppel et al. | |
| 5,992,022 | A * | 11/1999 | Carrera Moya | 30/113 |
| 6,164,286 | A | 12/2000 | Schad | |
| 6,446,344 | B1 | 9/2002 | Gontar | |
| 7,418,785 | B2 * | 9/2008 | Whitemiller et al. | 30/182 |
| D617,496 | S * | 6/2010 | Wong | D27/195 |
| 7,770,295 | B2 * | 8/2010 | Smith | 30/113 |
| 2003/0188433 | A1 * | 10/2003 | Yu | 30/113 |

FOREIGN PATENT DOCUMENTS

| | | |
|---|---|---|
| CN | 201216167 Y | 4/2009 |
| FR | 2 827 538 | 1/2003 |

OTHER PUBLICATIONS

French Search Report dated Jun. 12, 2009, from corresponding French application.

* cited by examiner

*Primary Examiner* — Omar Flores Sanchez
(74) *Attorney, Agent, or Firm* — Young & Thompson

(57) ABSTRACT

Cigar cutter (1) includes a housing (2) that has a cutting opening (3), a first movable blade module (4), and a second movable blade module (5) relative to the housing between a closed configuration, in which the blades (19, 23) of the blade modules close the cutting opening, and an open configuration, in which the blades of the blade modules release the cutting opening, whereby a locking mechanism is able, in a locked state, to keep the blade modules within the closed configuration, and, in an unlocked state, to allow the blade modules to switch to the open configuration. The blade modules are able to move toward one another from the closed configuration to an actuation configuration, whereby the locking mechanism is able to switch from the locked state to the unlocked state and vice versa during the switching from the closed configuration to the actuation configuration.

23 Claims, 4 Drawing Sheets

CIGAR CUTTER

TECHNICAL FIELD OF THE INVENTION

This invention relates to a cigar cutter.

PRIOR ART

The document U.S. Pat. No. 5,937,523 describes a cigar cutter that comprises two movable blades between a closed configuration, in which they close the cutting opening of the cigar cutter, and an open configuration, in which they release the cutting opening. A bolt makes it possible to keep the blades in the closed configuration. To cut a cigar, it is necessary to move the bolt downward, which has the effect of allowing the blades to switch to the open configuration under the action of a spring, and then to rest on the blades.

The user is therefore to change the position of his hands during use. The use of the cigar cutter is therefore not easy and quick.

In the above-mentioned document, the blades have a rotational movement relative to one another. There are also cigar cutters in which the blades have a translational movement relative to one another, and in which the same problems of manipulating a bolt are encountered.

SUMMARY OF THE INVENTION

One problem that this invention proposes to resolve is to facilitate the use of a cigar cutter. In particular, one object of the invention is to provide a cigar cutter in which the blades can be unlocked quickly and easily.

The solution that is proposed by the invention is a cigar cutter that comprises a housing that has a cutting opening, a first movable blade module, and a second movable blade module relative to said housing between a closed configuration, in which the blades of the blade modules close said cutting opening, and an open configuration, in which the blades of said blade modules release said cutting opening, whereby a locking mechanism is able, in a locked state, to keep said blade modules within said closed configuration, and, in an unlocked state, to allow said blade modules to switch to said open configuration, characterized by the fact that said blade modules are able to move toward one another from said closed configuration to an actuation configuration, whereby said locking mechanism is able to switch from the locked state to the unlocked state and vice versa during the switching from the closed configuration to the actuation configuration.

Owing to these characteristics, the user can switch the locking means from their locked state to their unlocked state only by resting on the blade modules to bring them closer to one another. After this unlocking, the blade modules can assume their open configuration, for example under the action of a spring. The user can then rest again on the blade modules to cut a cigar. During these manipulations, it is not necessary that he change the position of his hands. The use of the cigar cutter is therefore quick and easy.

According to a particular embodiment, the first blade module comprises at least a first foot that is received in a first opening of the housing, and the second blade module comprises at least a second foot that is received in a second opening of the housing.

Advantageously, said first opening and said second opening are adjacent and communicate via a slot.

The slot allows cooperation between the first foot and the second foot for forming the locking mechanism.

Preferably, said second foot has a rib that penetrates said first opening via said slot.

Advantageously, said first foot comprises a first toothed socket and a second toothed socket that moves in rotation and in translation relative to the first toothed socket.

Preferably, the first toothed socket has six teeth that are separated by six slots, whereby the second toothed socket has three pairs of teeth that are separated by three slots.

Advantageously, in said closed configuration, the rib works with the second toothed socket to preserve said closed configuration.

Preferably, during the movement to the actuation configuration, the rib works with the second toothed socket to make it rotate relative to the first socket and to make it possible to switch to the open configuration.

The above-mentioned characteristics are an embodiment of the locking mechanism.

Advantageously, said first opening has two other ribs.

According to one embodiment, play is present at a free end of said first foot.

Play allows the movement from the closed configuration to the actuation configuration.

BRIEF DESCRIPTION OF THE FIGURES

The invention will be better understood, and other objects, details, characteristics and advantages of the latter will emerge more clearly during the following description of a particular embodiment of the invention, provided only by way of illustration and in a non-limiting manner, with reference to the accompanying drawings. In these drawings.

DETAILED DESCRIPTION OF AN EMBODIMENT OF THE INVENTION

Figure 1:
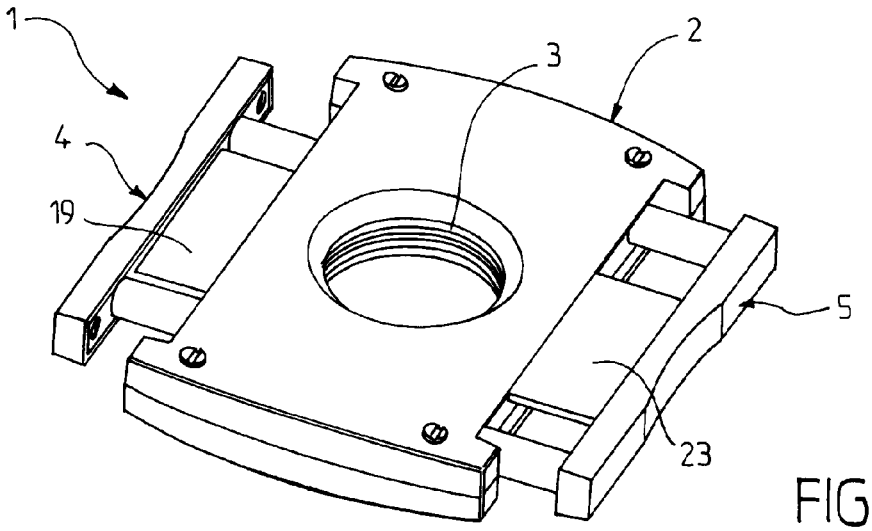
FIG. 1 is a perspective view of a cigar cutter according to an embodiment of the invention.

The cigar cutter 1 shown in FIG. 1 comprises a housing 2 with an essentially parallelepipedic shape, with a slight thickness, in the center of which a cutting opening 3 is found. The cigar cutter 1 also comprises a first blade module 4 and a second blade module 5.

The blade modules 4 and 5 can slide relative to the housing 1. In FIG. 1, they are shown separated from one another, in an open configuration. In this configuration, the blades of the blade modules 4 and 5 release the cutting opening 3, in which it is possible to insert the end of a cigar. By drawing blade modules 4 and 5 near to one another, the user can move their blades into the cutting opening 3 to cut in particular the end of the cigar or any other section.

With reference to FIGS. 2 to 6, the structure and the operation of the cigar cutter 1 are described below in a more detailed manner.

The housing 2 comprises two half-shells 6 of complementary shapes, between which a casing 7 is arranged. The half-shells 6 are attached to one another by screws 8.

The casing 7 has four circular-section openings 9 to 12 that extend parallel to one another. As can be seen in particular in FIG. 5, the openings 9 and 10 are separated by a wall 14, whereas a slot 15 allows communication between the openings 11 and 12. The casing 7 also comprises a central slot 13.

Figure 2:
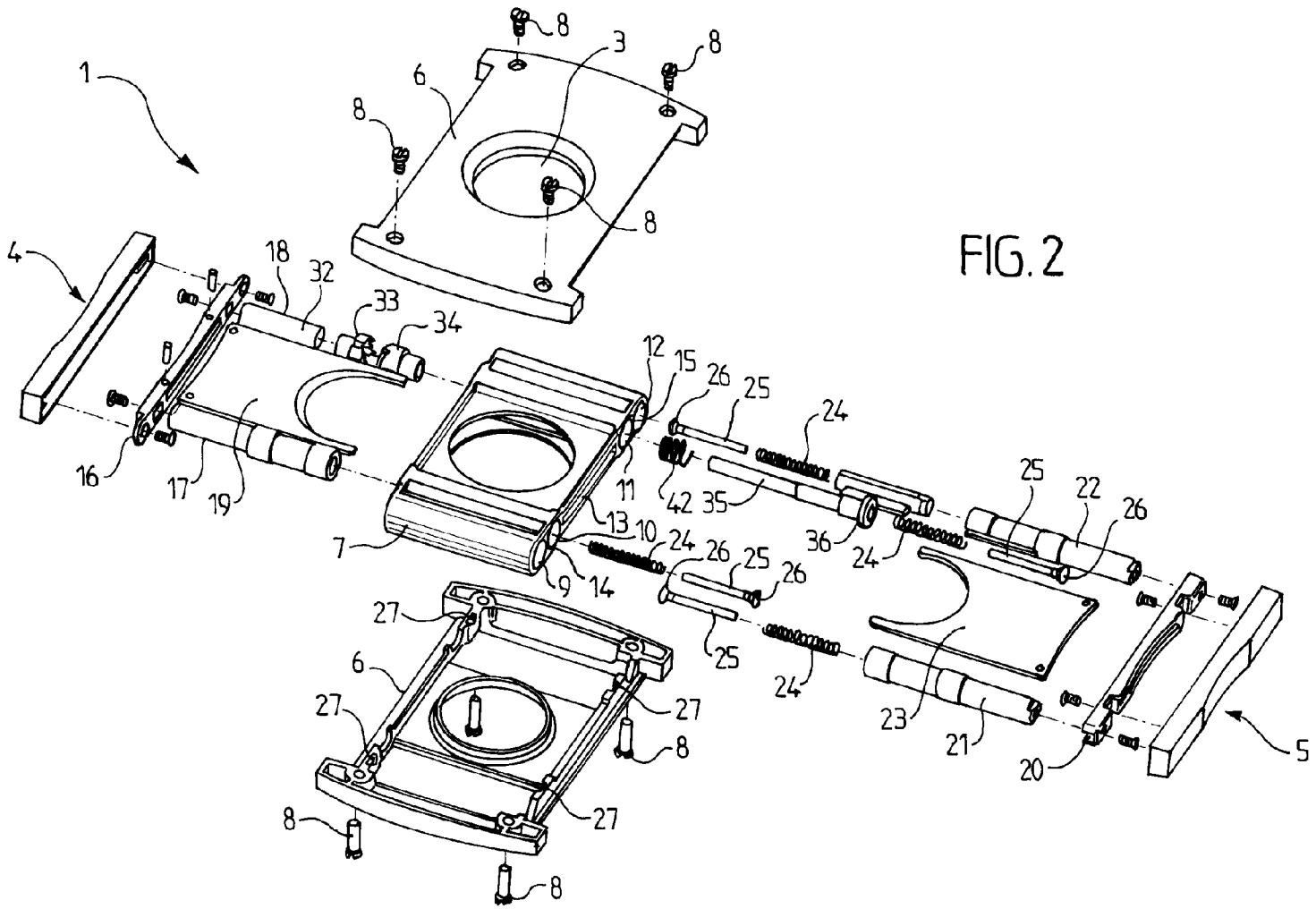
FIG. 2 is an exploded perspective view of the cigar cutter of FIG. 1, FIGS. 3 and 4 show, in perspective, two parts of the locking mechanism of the cigar cutter of FIG. 1, FIGS. 5 and 6 are two cutaway views of the cigar cutter of FIG. 1, respectively in closed configuration and in open configuration.
Figure 5:
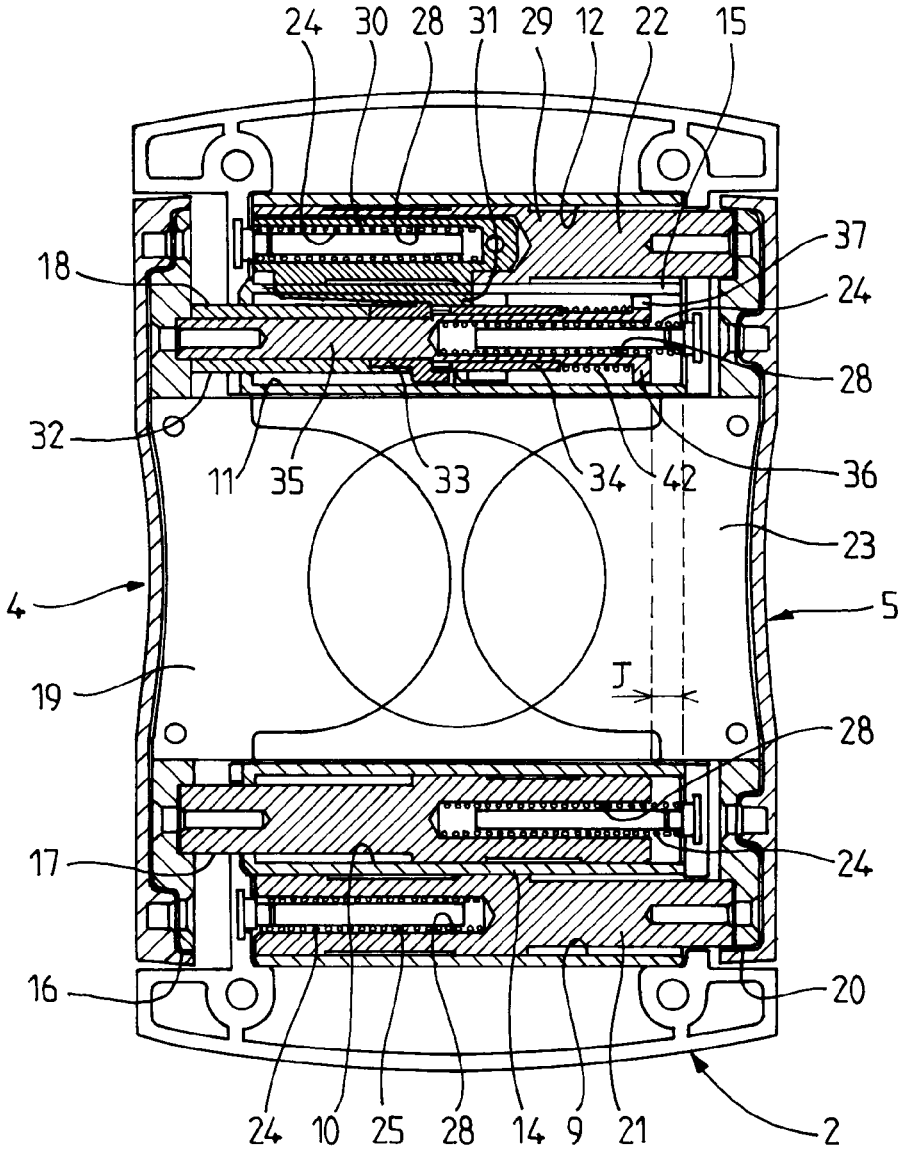
Figure 6:
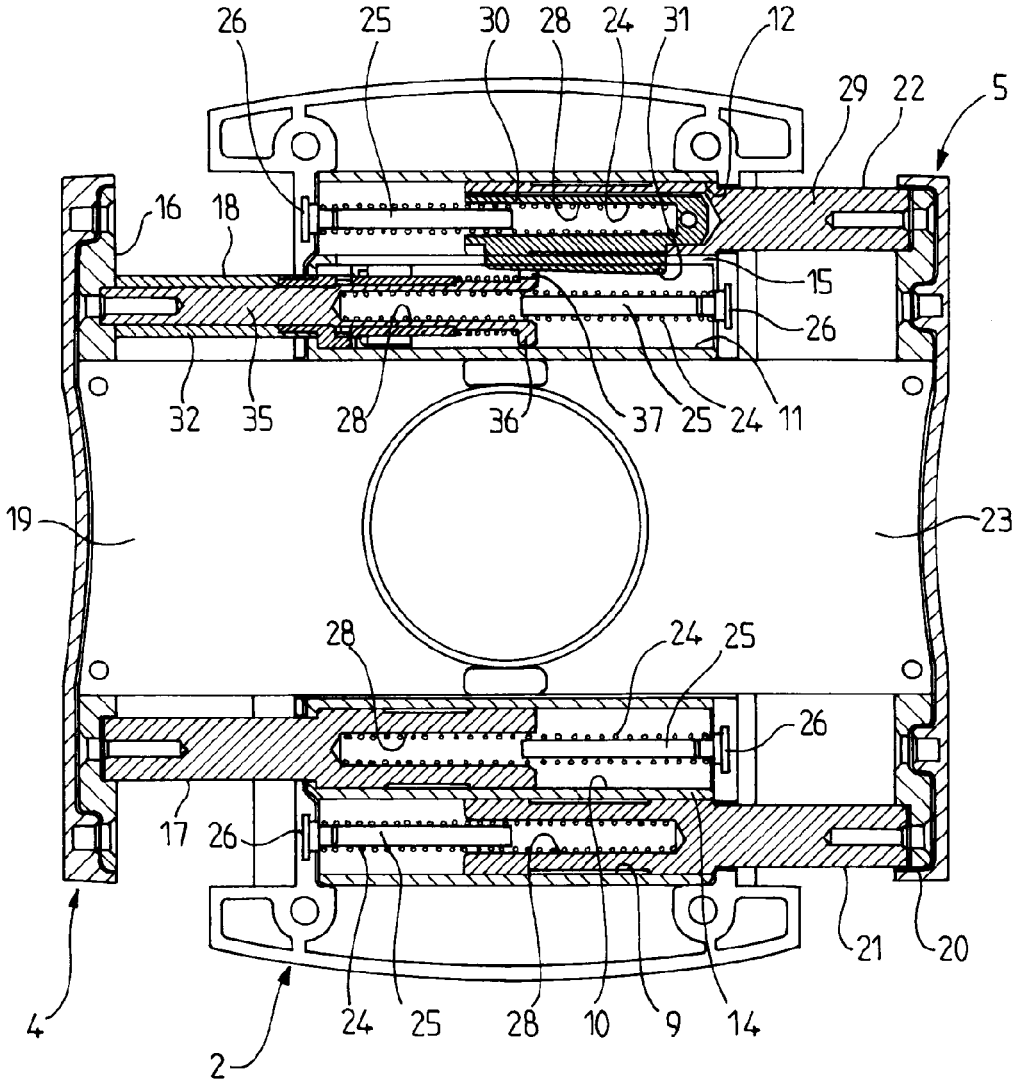

The first blade module 4 comprises a support 16, shaped like an elongated rod, as well as two feet 17 and 18 that are attached perpendicularly to the support 16. The first blade module 4 also comprises a blade 19 that is attached to the support 16. The blade 19 is essentially planar and has a cutting edge in the shape of an arc. As FIGS. 5 and 6 show, the feet 17 and 18 can slide respectively into the openings 10 and 11 of the casing 7, whereas the blade 19 can slide into the slot 13. FIG. 2 shows additional assembly details of the first blade module 4, which do not require a detailed description.

Similarly, the second blade module 5 comprises a support 20 as well as two feet 21 and 22 that are attached perpendicularly to the support 20. The second blade module 5 also comprises a blade 23 that is attached to the support 20. As FIGS. 5 and 6 show, the feet 21 and 22 can slide respectively into the openings 9 and 12 of the casing 7, whereas the blade 23 can slide into the slot 13.

Each foot 17, 18, 21, 22 has a central opening 28, in which a spring 24 is arranged. Each spring 24 is also guided by a rod 25 that has a head 26 that is received in a receptacle 27 that is provided in the housing 2. The spring 24 rests, on the one hand, on the head 26, and, on the other hand, on the bottom of the central opening 28.

Thus, the four springs 24 have the effect of pushing the blade modules 4 and 5 at a distance from one another in the open configuration of FIG. 6. The cigar cutter 1 also comprises a locking mechanism, described below, which makes it possible to hold the blade modules 4 and 5 close to one another, in a closed configuration shown in FIG. 5.

As can be seen in particular in FIG. 2, the feet 17 and 21 have a relatively simple structure, whereby their function is primarily to guide the movement of the blade modules 4 and 5 relative to the housing 2. In contrast, the structure of the feet 18 and 22 is more developed because, in addition to their guiding function, they form the locking mechanism that makes it possible to hold the blade modules 4 and 5 in the closed configuration.

The foot 22 comprises a first part 29 that is attached to the support 20, and a second part 30 that is attached to the first part 29. The part 30 has a rib 31 that projects, via the slot 15, into the opening 11 of the casing 7. The rib 31 can therefore work with the foot 18. This two-part production facilitates the manufacturing and makes possible a suitable selection of material for each part.

The foot 18 comprises a rod 35 that is attached to the support 16. The rod 35 has, on the side opposite to the support 16, a collar 36 in which a slot 37 is provided opposite the slot 15. The foot 18 also comprises, surrounding the rod 35 and successively from the support 16, a cylinder 32, a first toothed socket 33, and a second toothed socket 34, and a spring 42. The cylinder 32 and the first toothed socket 33 are attached relative to the rod 35 by insertion with force. In contrast, the second toothed socket 34 can slide along the rod 35 and rotate around the latter. The spring 42 pushes the second toothed socket 34 toward the first toothed socket 33.

Figure 3:
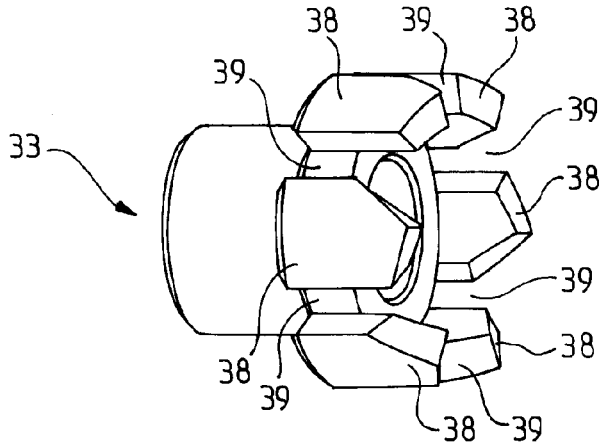

The first toothed socket 33 is shown in perspective in FIG. 3. It comprises six teeth 38 that are distributed in a circle and separated by slots 39.

Figure 4:
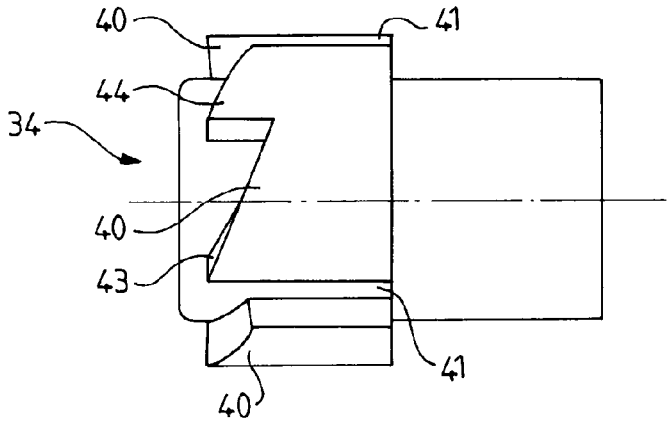

The second toothed socket 34 is shown in FIG. 4. It has three pairs of teeth 40, separated by three slots 41 that are distributed at 120° from one another. Each pair of teeth 40 has a first tooth 43 and a second tooth 44. As can be seen in FIG. 4, the tooth 43 is inclined toward the tooth 44, which is inclined toward a slot 41.

Also, two ribs that are not visible in the Figures are found in the opening 11 of the casing 7. These ribs extend longitudinally approximately over the same length as the rib 31 in the configuration of FIG. 5. These two ribs form, with the rib 31, a set of three ribs distributed at 120° from one another.

The operation of the cigar cutter 1 is as follows.

In the closed configuration shown in FIG. 5, the rib 31 and the ribs of the opening 11 pass through three slots 39 of the first toothed socket 33 and rest against the second toothed socket 34, each on a tooth 43. Under the effect of the springs 24, the ribs push on the second toothed socket 34, and the latter therefore is not engaged with the first toothed socket 33. The cooperation between the ribs and the teeth 43 makes the toothed socket 34 rotate until the ribs reach the bottom of the teeth 43. The cooperation between the ribs and the second toothed socket 34 therefore prevents, on the one hand, the rib 31 from sliding to the right of FIG. 5, and, on the other hand, the second toothed socket 34 from sliding to the left of FIG. 5. Thus, the blade modules 4 and 5 cannot move under the effect of the springs 24 and are held in the closed configuration of FIG. 5.

From the closed configuration shown in FIG. 5, the user can rest on the blade modules 4 and 5 for drawing them near to one another to an actuation configuration, not shown. This movement is possible using play J that exists at the ends of feet 17 and 18. In one variant, play exists even at the level of the ends of feet 21 and 22.

During this movement toward the actuation position, the second toothed socket 34 moves toward the right of FIG. 5 until it is released from the rib 31 and ribs of the opening 11. In addition, under the action of the spring 42, the teeth 38 of the first toothed socket 33 work with the teeth 43 and 44 of the second toothed socket 34 and make the latter rotate until the teeth 43 and 44 are offset by 60° relative to the teeth 38.

When the user simultaneously releases the pressure that he exerted on the blade modules 4 and 5, the latter will move in opposite directions under the action of the springs 24. During this movement, the ribs rest on the second toothed socket 34, but this time at the level of the teeth 44, due to the above-mentioned 60° rotation. Then, the ribs push on the teeth 44 until the two toothed sockets are disengaged. The second toothed socket 34 can then rotate until the ribs and slots 39 are aligned with the slots 41. Owing to this alignment, the above-mentioned cooperation between the ribs and the second toothed socket 34 is eliminated, which makes it possible for the blade modules 4 and 5 to move until reaching the open configuration shown in FIG. 6. The slot 37 of the rod 35 allows the switching of the rib 31 beyond the collar 36.

It is possible to see in FIG. 6 that the feet 17, 18, 21 and 22 have shoulders that rest on the housing 2, thus defining the position of the blade modules 4 and 5 in the open configuration.

In the open configuration, the user can place in particular the end of a cigar or any other section in the cutting opening 3. Then, he can rest on the blade modules 4 and 5, for drawing one near the other, and cut the end of the cigar with the blades 19 and 23. During this movement, the alignment of the slots 41 with the slots 39 is preserved by the ribs of the opening 11. The rib 31 can therefore go back from the left side (according to the view from FIG. 5) of the second toothed socket 34.

By continuing to rest on the blade modules 4 and 5, the user reaches the actuation position. This causes, in a manner that is similar to that which is described above, a rotation of the second socket 34. The teeth 43 are again found opposite the ribs. In other words, the cigar cutter 1 is again in the closed configuration.

It is understood from the preceding that when the ribs of the opening 11 and the rib 31 are found opposite the teeth 43, the switching to the open configuration of FIG. 6 is prevented. In other words, the locking mechanism is in a locked position. If the user rests on the blade modules to switch to the actuation position, the second socket 34 rotates, and these are the teeth 44 that are found opposite the ribs. Switching to the open configuration is then possible. In other words, the locking mechanism is in an unlocked position.

If, from the open configuration, the user rests on the blade modules 4 and 5 to switch to the closed configuration, and then to the actuation configuration, the second socket 34 also rotates, and these are again the teeth 43 that are found opposite the ribs. The locking mechanism is again in a locked position.

Although the invention has been described in connection with a particular embodiment, it is quite obvious that it is in no way limited and that it comprises all of the technical equivalents of the means that are described as well as their combinations if the latter fall within the scope of the invention.

The invention claimed is:

1. A cigar cutter (1) comprising:

a housing (2) that has a cutting opening (3);

a first movable blade module (4);

a second movable blade module (5) relative to said housing between a closed configuration, in which blades (19, 23) of the first and second blade modules close said cutting opening, and an open configuration, in which the blades of said first and second blade modules release said cutting opening; and a locking mechanism configured, in a locked state, to keep said blade modules within said closed configuration, and, in an unlocked state, to allow said blade modules to switch to said open configuration, said blade modules configured to move toward one another from said closed configuration to an actuation configuration, and said locking mechanism configured to switch from the locked state to the unlocked state and vice versa during the switching from the closed configuration to the actuation configuration, wherein the first blade module (4) comprises at least one first foot (18) that is received in a first opening (11) of the housing and the second blade module (5) comprises at least one second foot (22) that is received in a second opening (12) of the housing, wherein said first foot comprises a first toothed socket (33) and a second toothed socket (34) that moves in rotation and in translation relative to the first toothed socket, and wherein in the closed configuration, the first toothed socket (33) and the second toothed socket (34) are not engaged with each other, the first toothed socket (33) and the second toothed socket (34) being engaged with each other when the blade modules move toward one another from the closed configuration to the actuation configuration.

2. The cigar cutter according to claim 1, wherein said first opening and said second opening are adjacent and communicate via a slot (15).

3. The cigar cutter according to claim 2, wherein said second foot (22) has a rib (31) that penetrates said first opening (11) via said slot (15).

4. The cigar cutter according to claim 1, wherein the first toothed socket has six teeth (38) that are separated by six slots (39), whereby the second toothed socket has three pairs of teeth (40) that are separated by three slots (41).

5. The cigar cutter according to claim 1, wherein, in said closed configuration, the rib (31) works with the second toothed socket (34) to preserve said closed configuration.

6. The cigar cutter according to claim 5, wherein during the movement toward the actuation configuration, the rib (31) works with the second toothed socket (34) to make it rotate relative to the first socket (33) and to make it possible to switch to the open configuration.

7. The cigar cutter according to claim 3, wherein said first opening has two other ribs.

8. The cigar cutter according to claim 1, wherein play (J) is present at the level of a free end of said first foot (18).

9. The cigar cutter according to claim 4, wherein, in said closed configuration, the rib (31) works with the second toothed socket (34) to preserve said closed configuration.

10. The cigar cutter according to claim 1, wherein said first opening has two other ribs.

11. The cigar cutter according to claim 4, wherein said first opening has two other ribs.

12. The cigar cutter according to claim 5, wherein said first opening has two other ribs.

13. The cigar cutter according to claim 6, wherein said first opening has two other ribs.

14. A cigar cutter (1) comprising:

a housing (2) that has a cutting opening (3);

a first movable blade module (4);

a second movable blade module (5) relative to said housing between a closed configuration, in which blades (19, 23) of the first and second blade modules close said cutting opening, and an open configuration, in which the blades of said first and second blade modules release said cutting opening; and a locking mechanism configured, in a locked state, to keep said blade modules within said closed configuration, and, in an unlocked state, to allow said blade modules to switch to said open configuration, said blade modules configured to move toward one another from said closed configuration to an actuation configuration, and said locking mechanism configured to switch from the locked state to the unlocked state and vice versa during the switching from the closed configuration to the actuation configuration, wherein the first blade module (4) comprises at least one first foot (18) that is received in a first opening (11) of the housing and the second blade module (5) comprises at least one second foot (22) that is received in a second opening (12) of the housing, wherein said second foot (22) has a rib (31) that penetrates said first opening (11) via said slot (15), and wherein said first opening has two other ribs.

15. The cigar cutter according to claim 14, wherein said first opening and said second opening are adjacent and communicate via a slot (15).

16. The cigar cutter according to claim 15, wherein said first foot comprises a first toothed socket (33) and a second toothed socket (34) that moves in rotation and in translation relative to the first toothed socket.

17. The cigar cutter according to claim 13, wherein said first foot comprises a first toothed socket (33) and a second toothed socket (34) that moves in rotation and in translation relative to the first toothed socket.

18. The cigar cutter according to claim 17, wherein the first toothed socket has six teeth (38) that are separated by six slots (39), whereby the second toothed socket has three pairs of teeth (40) that are separated by three slots (41).

19. The cigar cutter according to claim 17, wherein, in said closed configuration, the rib (31) works with the second toothed socket (34) to preserve said closed configuration.

20. The cigar cutter according to claim 19, wherein during the movement toward the actuation configuration, the rib (31) works with the second toothed socket (34) to make it rotate relative to the first socket (33) and to make it possible to switch to the open configuration.

21. The cigar cutter according to claim 17, wherein the first toothed socket has six teeth (38) that are separated by six slots (39), whereby the second toothed socket has three pairs of teeth (40) that are separated by three slots (41).

22. The cigar cutter according to claim 14, wherein play (J) is present at the level of a free end of said first foot (18).

23. The cigar cutter according to claim 14, wherein the two other ribs form, with the rib (31), a set of three ribs distributed at 120° from one another.

* * * * *